US005731749A

United States Patent [19]

Yrjölä et al.

[11] Patent Number: 5,731,749

[45] Date of Patent: Mar. 24, 1998

[54] TRANSMISSION LINE RESONATOR FILTER WITH VARIABLE SLOT COUPLING AND LINK COUPLING #10

[75] Inventors: Seppo Yrjölä, Oulunsal; Kimmo Koskiniemi, Oulu, both of Finland

[73] Assignee: LK-Products OY, Kempele, Finland

[21] Appl. No.: 631,332

[22] Filed: Apr. 12, 1996

[51] Int. Cl.[6] ..... H01D 1/20

[52] U.S. Cl. ..... 333/206; 333/219; 333/204

[58] Field of Search ..... 333/202–207, 333/219, 222

[56] References Cited

U.S. PATENT DOCUMENTS 5,047,739 9/1991 Kuokkanen ..... 333/219

FOREIGN PATENT DOCUMENTS 28 23 785 12/1978 Germany ..... H01P 1/20

WO 89/05046 6/1989 WIPO ..... H01P 1/20

*Primary Examiner*—Robert Pascal

*Assistant Examiner*—Darius Gambino

*Attorney, Agent, or Firm*—Darby & Darby

[57] ABSTRACT

The invention relates to a radiofrequency filter in which the coupling between the transmission line resonators is effected by using both a slot coupling and a link coupling. The coupling slot and the coupling link are designed so that changes of the coupling intensity in the link coupling caused by shifting of the resonator element is of the same size and of the opposite sign as a corresponding change in the slot coupling, whereby the changes compensate one another. The design is based on the fact that the distance of the coupling link from the resonator is longer close to the coupling slot than far away from the coupling slot.

6 Claims, 3 Drawing Sheets

FIG. 3
PRIOR ART
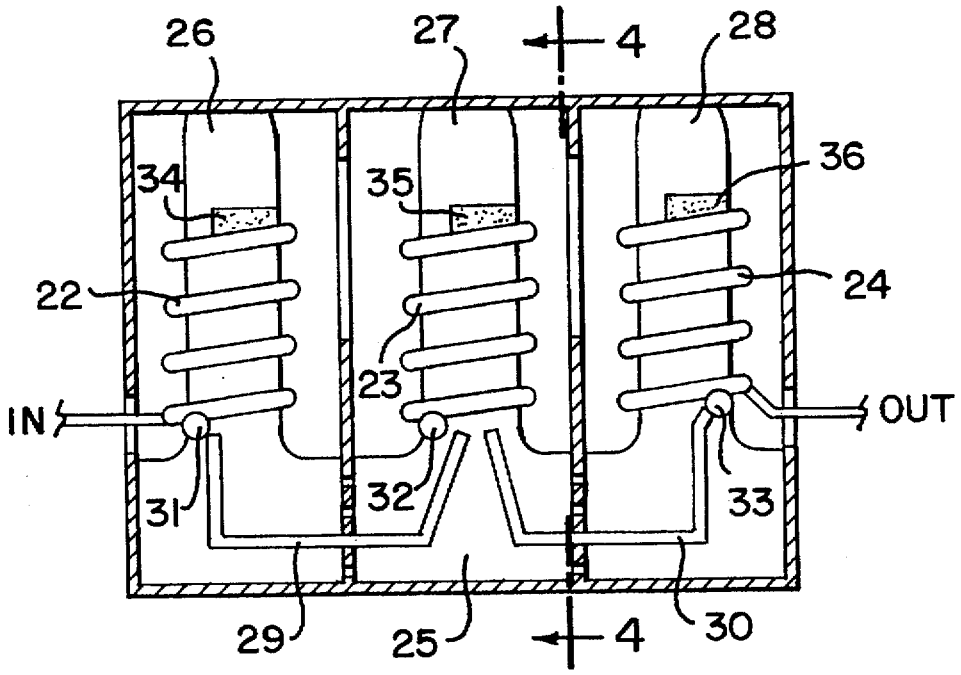
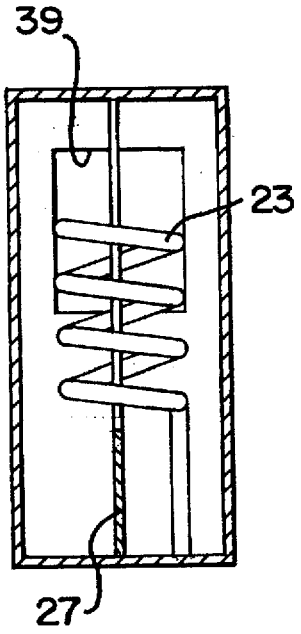
FIG. 4
PRIOR ART

TRANSMISSION LINE RESONATOR FILTER WITH VARIABLE SLOT COUPLING AND LINK COUPLING #10

FIELD OF THE INVENTION

The present invention relates to a filter structure intended for radio frequencies in which the electromagnetic couplings between the resonators of the transmission line resonator filter are implemented by a combination of slot couplings and link couplings.

BACKGROUND OF THE INVENTION

Various coils and capacitors are generally used as basic parts in electrotechnical filters. With frequencies of the order of hundred megahertz, losses begin to grow, especially the side effects caused by the structure of capacitors. The losses are mainly caused by the series inductances of the capacitors and the capacitance between the coil turns relative to the surroundings. Up to a certain limit, the problems can be reduced by capacitor and coil structures. However, when frequencies grow, the losses of both coils and capacitors increase in the end to such an extent that various transmission line and cavity resonators are the only alternative as far as losses are concerned.

Coaxial resonators are widely used in applications where small losses and great power handling capacity and selectivity are needed and where the resonator is allowed a relatively large size. The losses decrease and the power handling capacity is improved with increasing resonator size. On higher frequencies up to about 10–15 GHz, various strip line resonators are also widely used. In the frequency range from 100 MHz to 2 GHz where conventional coils and capacitors cannot be used any longer because of stray quantities and great losses, and where various, e.g., quarter-wave coaxial and strip line resonators are also too large in size, helix resonators are in general use.

The middle wire of the helix resonator is a metal wire wound in the form of a cylindrical coil, i.e., a helix, which is fitted in a metal housing or a housing coated with metal, i.e. in an external conductor. These together form the transmission line resonator structure. Generally, the helix resonator functions as a quarter-wave resonator, whereby the one end of the middle wire is open and the other one is grounded in the housing.

The helical structure can be used to achieve an extremely good volume/loss ratio. Within the frequency range from 100 to 1000 MHz, and the Q value range from 400 to 1000, the size of a helix resonator is about one third of that of a coaxial resonator with similar properties.

The housing of the helix resonator has a cross-section perpendicular to the axis of the helix, which cross-section is generally in the form of a circle, square, or a rectangular, and it is manufactured, in a similar manner as the middle wire, of material which conducts electricity as well as possible to minimize losses. The ratio of the diameter of the helix coil to the inner diameter of the outer shell and the pitch of the coil mainly define the specific impedance of a helix resonator, and through this, the resonance frequency.

In practical applications, the helix resonator has to be supported in order to strengthen its mechanical structure and to prevent the "ringing" caused by the physical oscillation of the resonator. Special attention has to be paid to the selection of the material of the supporting structure. The material has to be as small-loss as possible, mechanically durable, and its thermal expansion properties have to be as stable as possible. The supporting material has an impact, not only on its Q factor, but also on the specific impedance on the helix resonator.

A helix filter consists of a series of helix resonators interconnected electromagnetically. The couplings between the resonators in narrowband applications are traditionally implemented by using coupling slots in the walls of the helix cavities, and in wideband applications by using discrete coils and capacitors or link repeaters. The couplings to the input and output of the filter are provided by using various loop couplings, probe couplings, or tap couplings. Of these the tap couplings are used most frequently because of their mechanical durability and the DC-earthing properties.

FIG. 1 presents a typical helix bandpass filter according to prior art, in which the couplings between the resonators are implemented by a capacitive slot and an inductive slot. It is known that helix resonators can be coupled to one another by coupling slots either capacitively through the electric field of the upper part of the helix, or inductively through the magnetic field between the lowest turns. The intensity of the coupling can be effected by altering the size of the coupling slot and possibly its position in the partition wall of the set of cavities. Another coupling method, e.g.. the one disclosed in U.S. Pat. No. 4,374,370, is to use link repeaters of a U-shape between the resonators according to FIG. 2. In a similar manner to the slot coupling, the link can be placed in the open end (link 17) of the helix coil in which the electric field is in its maximum, or in the short-circuited end (link 18) in which the magnetic field achieves its maximum value, respectively. Furthermore, the link couplings can be situated in both the open and the short-circuited ends, whereby the ratio and size of the capacitive and inductive couplings of the helix resonators can be adjusted.

In small-size filters in which the unloaded Q value is only a few hundreds, a capacitive coupling is generally used. Because of the low Q factor, only the coupling between the electric fields of the highest turns is strong enough to transfer a sufficient amount of energy from one resonator to another. In filters with high Q values, the inductive coupling between the magnetic fields is also capable of transferring enough energy. Because of the different electromagnetic nature of the couplings, the frequency responses of filters implemented by them differ from one another. Is has been perceived, that compared to a symmetric filter, a capacitive coupling provides a considerably higher attenuation on frequencies below the passband, and the inductive coupling in the frequency range above the passband, respectively. The difference between the couplings results in an asymmetric frequency response called "skewing" which is typical of helix resonators.

A helix band-pass filter which is only based on slot couplings does not necessarily provide enough attenuation on the frequencies above and below the pass band. Additional attenuation can be provided by adding zero points to the transfer function of the filter. These zero points are implemented by coupling the helixes to one another not only through a slot coupling, but also through a strip coupling. By using different strip couplings, zero points can be provided above or below the pass band. The positions of the zero points can be adjusted by altering the intensity of the strip coupling.

The coupling of the electromagnetic fields between the helixes are influenced by, for instance, the distance between the helixes, the position of the helixes with respect to the coupling slot or the coupling link, the position of the open end and the base of the helix with respect to the coupling slot or the coupling link, the variations of the effective diameter of the helix, and the asymmetry of the cross-section of the helix.

Because of their good high-frequency properties and especially the small size, the helix resonator filters are used in high-frequency radio sets, especially in portable radio sets and car radio sets. As the sizes of radio sets decrease, the sizes of filters have also decreased to a considerable extent, requiring more accuracy than before in the manufacture and assembly of high-frequency components. The explosive increase of mobile communications has caused a shift in the telephone and filter manufacture from special-purpose production to mass production, which, in turn, sets increasingly tighter requirements for the manufacture and tolerances.

It is obvious that coupling slots in different types of filter and even between different resonators of the same filter can be of different sizes. The slot shall be manufactured very accurately; in practice, the tolerances for width and height are in the order of ±0.01 mm. In this case, each filter version and partition wall of the filter needs respective stages of production as well as tools, increasing the cost of manufacture. Another disadvantage of the structure is the high requirement for accuracy for the positioning of the helix with respect to the coupling slot. The grade of accuracy is the same as that of the coupling slot.

An advantage of the link coupling presented in FIG. 2 is that by using it, a similar set of cavities can be used in the filters, decreasing the cost of manufacture with respect to the cavities. On the other hand, the filter- and coupling-specific links with the respective supporting structures needed in the structure are excess components compared to the slot technology, which increase the cost of manufacture. Furthermore, the requirements for manufacturing tolerances and accuracy of installation set for the coupling links are in the same order as those of the window couplings. Thus the link coupling described in U.S. Pat. No. 4,374,370 does not offer essential advantages concerning the manufacturing technology, compared to the slot coupling, and the electrotechnical advantages offered by it are restricted to the implementation of wideband filters.

SUMMARY OF THE INVENTION

The purpose of the present invention is to provide a resonator coupling structure for helix resonator filters in particular, which partly eliminates and partly reduces the above-mentioned disadvantages related to the slot and link coupling structures and, on the other hand, combines the advantages of the coupling slot and linking techniques by offering new degrees of freedom to the filter design. The object is achieved by a structure in which the resonators are coupled to one another both through a slot coupling and a link coupling. That part of the coupling link where the actual connection to the resonator takes place is designed with respect to the location of the coupling slot so that the changes in the intensity of the link and slot couplings due to movements of the resonator member are equally high, and of opposite signs.

The invention is characterized in that the link member (45; 51) comprises a connecting portion at each transmission resonator, which connecting portion the resonator is connected to electromagnetically, and the distance of the said connecting portion from the resonator member is longer close to the coupling slot (43; 50) than it is at a distance from the coupling slot.

BRIEF DESCRIPTION OF THE DRAWINGS

The invention is described in detail with reference to the appended drawings in which:

FIG. 3 presents the transmission resonator filter disclosed in U.S. Pat No. 5,047,739 in which the resonators are connected to one another by using slot couplings, FIG. 4 presents the structure of FIG. 3 as viewed from direction A—A.

DESCRIPTION OF THE PREFERRED EMBODIMENTS

First, known filter structures are described with reference to FIGS. 1–4.

Figure 1:
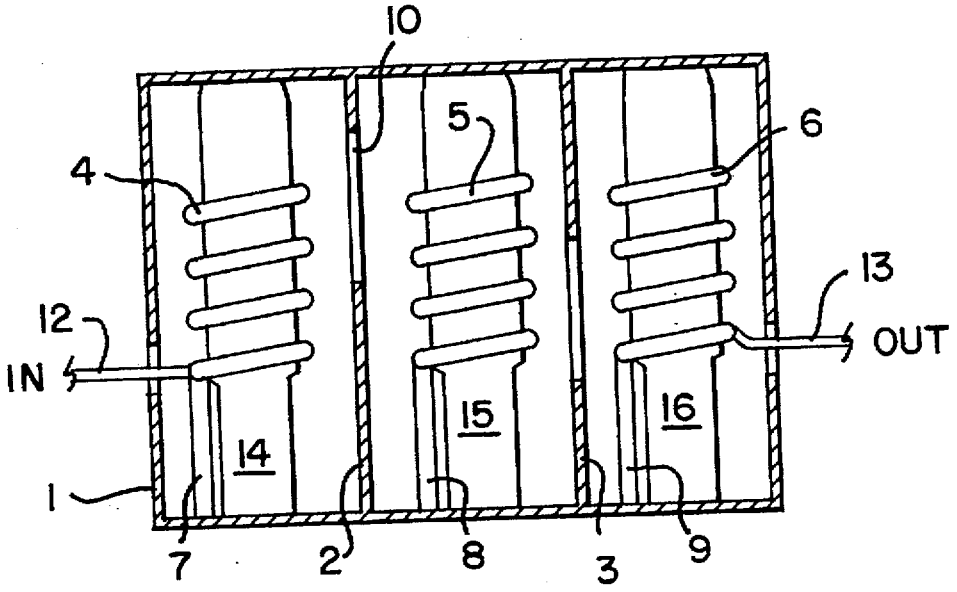
FIG. 1 PRIOR ART
FIG. 1 presents a known helix resonator filter in which the resonators are connected to one another by using slot couplings.

In a known radiofrequency filter of FIG. 1, a metal set of cavities 1 or set of cavities coated with metal is divided into three cavities by two partition walls 2 and 3. A helix coil 4, 5, 6 is placed in each cavity, the coil being connected at the so-called low-impedance end thereof to the bottom of the set of cavities 1 via a straight portion that forms the foot 7, 8, and 9 of the helix. The couplings between the helix resonators are made by using coupling slots 10 and 11 in the partition walls 2 and 3 of the helix cavities. Resonators 4 and 5 are interconnected capacitively via coupling slot 10 through the intermediation of an electric field. Resonators 5 and 6 are interconnected inductively via coupling slot 11 through a magnetic field. The couplings to the input and output of the filter are implemented by using conductors 12 and 13 soldered into helix coils 4 and 6. This arrangement is called a tap coupling. Helix coils 4, 5, and 6 are open at the upper, i.e., the high-impedance end thereof, forming a capacitive coupling at the end of the set of resonator cavities. The helix coils are supported by a supporting structure 14, 15, and 16 manufactured from a small-loss, temperature-stable insulating material which, in turn, is supported by the set of resonator cavities 1. The set of cavities 1 is earthed when the resonators are connected to the electric coupling.

Figure 2:
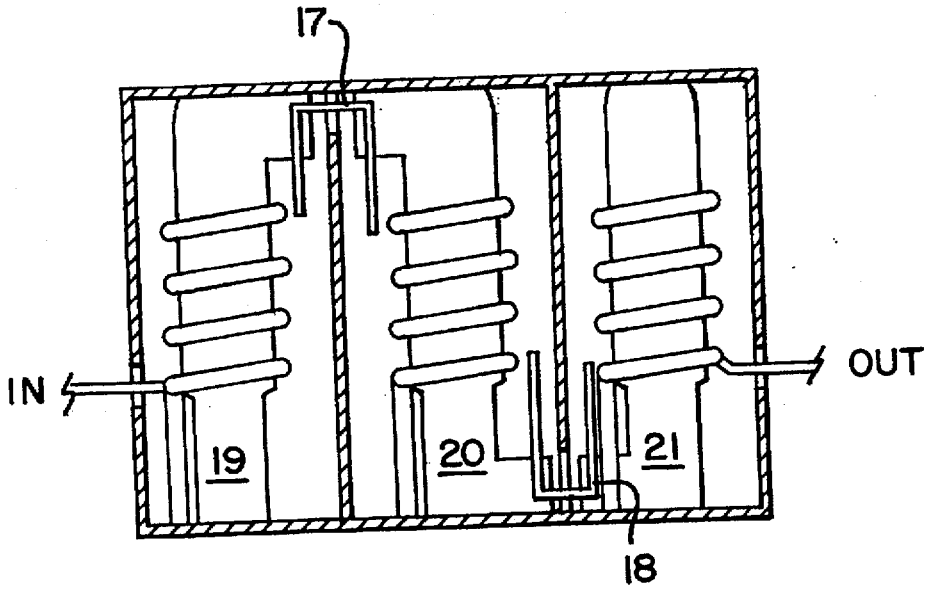
FIG. 2 PRIOR ART
FIG. 2 presents a known helix resonator filter in which the resonators are connected to one another by using link couplings.

In the known arrangement of FIG. 2, the couplings between the resonators are implemented by using conducting coupling link elements 17 and 18 of a U-shape instead of slot couplings. The coupling links in the structure are supported, by way of example, by supporting structure 19, 20, and 21 of the helix resonators.

The resonator structure according to patent FI 78198 (U.S. Pat. No. 5,047,739) presented in FIG. 3 comprises three helix resonators 22, 23, and 24. Each resonator is arranged around projections 26, 27, and 28 formed in a plate of insulating material 25. An electric circuit is formed by strip lines 29 and 30 in the lower part of insulating plate 25, to which circuit the resonators are connected galvanically, e.g., by soldering at points indicated with reference numbers 31, 32, and 33. Each resonator 22, 23, and 24 is further secured mechanically to projection 26, 27, and 28 by soldering to a metallized strip 34, 35, and 36 in the projection.

FIG. 4 presents a cross-section of FIG. 3 as viewed in direction A—A. Helix resonator 23 is supported around projection 27 formed in the insulating plate. The helix resonator is connected to the resonator in the adjacent cavity through coupling slot 39.

The invention is described in the following with reference to FIGS. 5 and 6.

Figure 5:
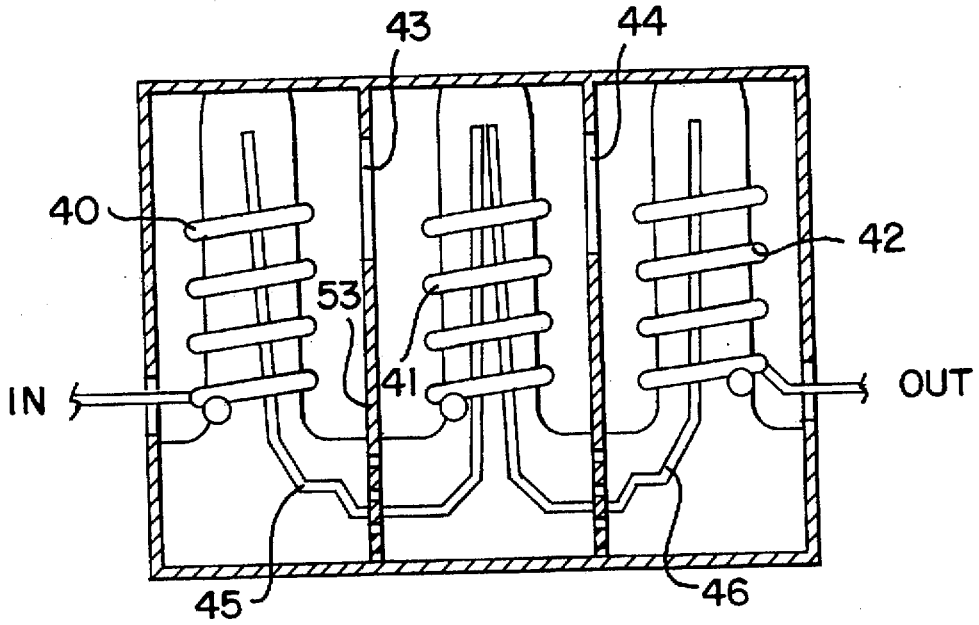
FIG. 5 presents the resonator filter structure according to the invention in which the resonators are coupled to one another by using both slot and link couplings, and the link member is designed so that the changes in the intensity of the link and slot couplings caused by the movement of the resonator member are equally large and of opposite signs.

FIG. 5 presents the helix resonator filter according to the invention. Strip structures acting as coupling links are added to the insulating plate, whereby the helix filter structure becomes very compact. The couplings between resonators 40, 41, and 42 are implemented, in addition to coupling slots 43 and 44, by coupling links 45 and 46 which are arranged obliquely to the axis of the helix in order to achieve the compensation between changes that occur in the link coupling and the slot coupling, according to the invention. The design is described below in detail. The coupling of a desired magnitude is formed through the joint impact of the slot and the strip. The electric field stored in the uppermost turns of the helix resonator is transferred to the adjacent resonator through the capacitive coupling slot. Furthermore, the energy of the electric field of the upper part of the helix and that of the magnetic field of the lowest turns of the helix resonator are transferred to the adjacent resonator through the coupling link. The portion of the coupling link which is inside the helix and via which the electromagnetic coupling is actually effected, is called the coupling portion of each resonator. The coupling between the helix and the coupling portion inside it is generally the stronger, the closer to the helix turn the coupling portion is.

The inventive idea of compensating the changes which occur because of the movement of the helix in the link and slot couplings is implemented by designing the coupling link and slot in the manner presented in FIG. 5: if the helix moves upwards from the supporting structure, the slot coupling tends to increase because a larger number of turns of the upper part of the helix is against the coupling slot. This is compensated by the link coupling, which tends to decrease because the connecting portion is placed obliquely to the axis of the helix on the insulating plate. The connecting portion in the upper part of the helix is closest to the axis of the helix and, consequently, the farthest away from the helix turn. With the helix moving upwards, the distance to the connecting part increases and the connection of the electric field to it decreases.

Figure 6:
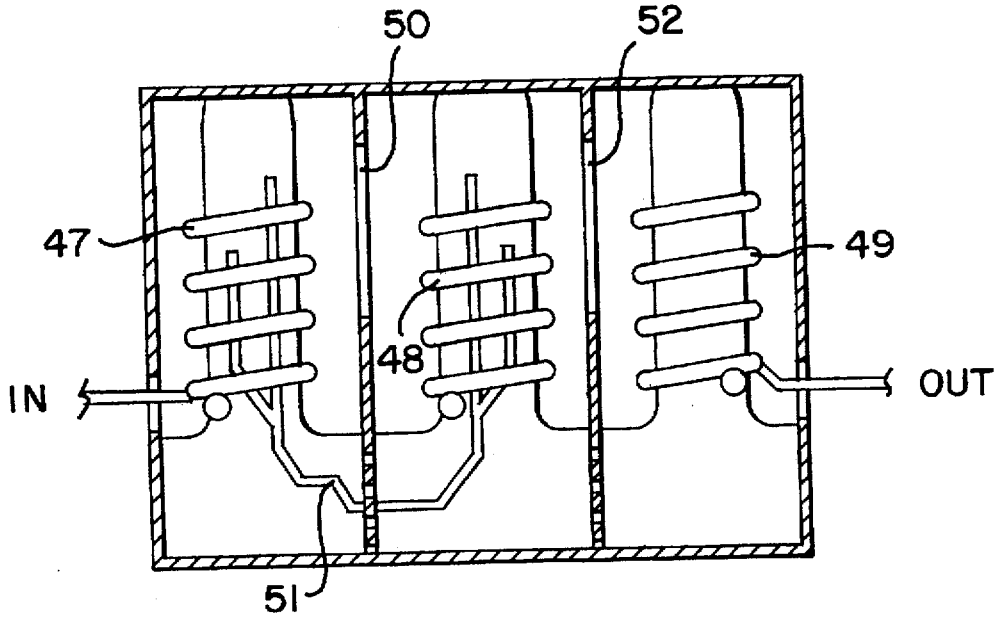
FIG. 6 presents another advantageous embodiment of the invention.

FIG. 6 presents another preferred embodiment of the helix resonator filter according to the invention. The coupling between resonators 47 and 48 is implemented by using capacitive slot 50 and coupling strip 51. The coupling between resonators 48 and 49 is implemented by capacitive slot 52. Coupling strip 51 is shaped so that the magnitude of the coupling remains constant independent of the positioning of the helix with respect to the strip and the slot because, in the lower parts of the helixes where the slot coupling is at its weakest, the total distance of the strip branches from the helix turn is at its smallest, corresponding to the strongest link connection.

An especially preferred application for the helix resonator filter according to the invention is the basic structure according to patent FI 78198 (U.S. Pat. No. 5,047,739) presented in FIGS. 3, 4, 5, and 6, in which the helix resonators are integrated to a strip line structure so that the insulating plate on whose surface the strip line structure is formed functions simultaneously as a mechanical support for the helix resonator. The arrangement is called a comb-structured helix resonator. The coupling links according to the invention can be easily formed on the insulating plate included in the structure almost with no extra costs. The coupling links are not discrete components like the metal U-conductors of FIG. 2 but they are integrated on the insulating plate, instead. They are easy to convert to be used in couplings of different sizes and types in different filter versions. Compared to traditional resonators connected either through electric or magnetic fields, the structure offers new prospects and degrees of freedom in filter designing because it enables a free adjustment of the ratio and magnitude of the capacitive and inductive coupling of helix resonators. Furthermore, it is possible to make the coupling selective by using additional components or strip structures to provide additional attenuation to the filter in desired frequencies.

Although the invention is described above with reference to the structure according to the appended drawings, it is obvious that the invention is not restricted to it but can be varied in many ways within the inventive idea described in the appended Claims. The number of helix resonators, for instance, can be varied and the dimensioning and design of different parts can be varied in many ways.

Furthermore, the present invention is not limited to any particular filtering technique or application but it can be used in various applications, by using different filtering techniques, such as helix, coaxial, and dielectric filters, and on different frequencies, preferably on radio frequencies, such as the UHF and the VHF.

The coupling arrangement according to the present invention provides a resonator filter structure which enables the replacement of different size coupling slots with standard slots and makes the coupling between the resonators insensitive to the manufacturing tolerances of the resonator structure, especially to the setting accuracy of the resonator in relation to the coupling elements, which is a considerable improvement to current prior art.

In the structure according to the invention a good reproducibility and mechanical simplicity are obtained, which makes mass production of the filters possible, improves the productive capacity and reduces manufacturing costs. Circuit technical solutions, which have been difficult to use previously on account of problems of reproduction, are now possible and improve the efficiency of the products.

We claim:

1. A radiofrequency filter comprising:

a set of cavities (1) made of electrically conductive material;

a first (40) and a second (41) transmission line resonator placed in the set of cavities;

a partition wall (53) having first and second sides made of electrically conductive material which is situated between said first and second transmission line resonators and which comprises a coupling slot (43) for interconnecting the first and the second transmission line resonators through an electromagnetic field; and a link member (45;51) of electrically conductive material, extending from the first side of said partition wall to the other side thereof, characterized in that the link member (45;51) comprises a connecting portion for establishing an electromagnetic coupling between said connecting portion and one of said transmission line resonators, said connecting portion being positioned relative to one of said transmission line resonators to thereby define a minimum distance between said connecting portion and one of said transmission line resonators, wherein said minimum distance varies as one of said transmission line resonators moves along a longitudinal axis.

2. A radiofrequency filter according to claim 1, further comprising an insulating plate which acts as a supporting structure for said resonators, and on the surface of which layouts are formed of conductive material, the layouts comprising said link member.

3. A radiofrequency filter according to claim 1, wherein said link member is a discrete conductor.

4. A radiofrequency filter according to any of the claim 1, characterized in that the resonators are helix resonators.

5. A radiofrequency filter according to claim 2, characterized in that the resonators are helix resonators.

6. A radiofrequency filter according to claim 3, characterized in that the resonators are helix resonators.

* * * * *